US009082288B2

(12) United States Patent
Wei et al.

(10) Patent No.: US 9,082,288 B2
(45) Date of Patent: Jul. 14, 2015

(54) ENGINEERING MACHINE AND STABILITY CONTROL SYSTEM AND CONTROL METHOD THEREOF

(75) Inventors: Zhikui Wei, Hunan (CN); Mingxing Shen, Hunan (CN); Minna Wang, Hunan (CN)

(73) Assignees: HUNAN SANY INTELLIGENT CONTROL EQUIPMENT CO., LTD, Hunan (CN); SANY HEAVY INDUSTRY CO., LTD, Hunan (CN)

( * ) Notice: Subject to any disclaimer, the term of this patent is extended or adjusted under 35 U.S.C. 154(b) by 295 days.

(21) Appl. No.: 14/002,107

(22) PCT Filed: Mar. 23, 2011

(86) PCT No.: PCT/CN2011/072087

§ 371 (c)(1),
(2), (4) Date: Aug. 28, 2013

(87) PCT Pub. No.: WO2011/120396

PCT Pub. Date: Oct. 6, 2011

(65) Prior Publication Data

US 2014/0015685 A1 Jan. 16, 2014

(30) Foreign Application Priority Data

Mar. 30, 2010 (CN) ..... 2010 1 0139806

(51) Int. Cl.
*G08B 21/00* (2006.01)
*G08B 21/18* (2006.01)
(Continued)

(52) U.S. Cl.
CPC ..... *G08B 21/182* (2013.01); *B66C 23/905* (2013.01); *F04B 15/02* (2013.01)

(58) Field of Classification Search
CPC ..... B66C 23/905; G08B 21/182; F04B 15/02; E02F 9/24; E02F 9/26
USPC ..... 340/679, 684, 685, 686.1, 689, 440; 701/50, 116, 124
See application file for complete search history.

(56) References Cited

U.S. PATENT DOCUMENTS 6,437,701 B1 * 8/2002 Muller ..... 340/679
7,012,540 B2 * 3/2006 Petzold et al. ..... 340/679

(Continued)

FOREIGN PATENT DOCUMENTS

CN 101457589 A 6/2009
CN 201366921 Y 12/2009

(Continued)

OTHER PUBLICATIONS

International Search Report of PCT/CN2011/072087, mailed Jun. 30, 2011.

*Primary Examiner* — Anh V La
(74) *Attorney, Agent, or Firm* — Collard & Roe, P.C.

(57) ABSTRACT

A stability control system for an engineering machine and a control method are provided. The stability control system includes a detection device (1), a control device (2) and an alarm device (3). The detection device (1) detects the current center-of-gravity positions of each component of the engineering machine to obtain the center-of-gravity position signals of each component and transmits the center-of-gravity position signals to the control device (2). The control device (2) receives the center-of-gravity position signals from the detection device (1), calculates the center-of-gravity position of the engineering machine according to a center-of-gravity calculation strategy, and compares it with a preset balance range. The control device (2) controls the alarm device (3) for warning when the center-of-gravity position of the engineering machine exceeds the balance range. The stability control system adopts a brand new method to control the stability of the engineering machine in working process, and has higher control precision. An engineering machine comprising the above stability control system is also provided.

12 Claims, 5 Drawing Sheets

(51) Int. Cl.
*B66C 23/90* (2006.01)
*F04B 15/02* (2006.01)

(56) References Cited

U.S. PATENT DOCUMENTS

2004/0158380 A1 8/2004 Farber et al.
2004/0232632 A1* 11/2004 Beck et al. ..... 280/5.5
2007/0089925 A1* 4/2007 Addleman ..... 180/313
2011/0042164 A1* 2/2011 Clark et al. ..... 182/2.2
2014/0015685 A1 1/2014 Wei et al.

FOREIGN PATENT DOCUMENTS

CN 101659386 A 3/2010
CN 101833287 A 9/2010
CN 201619959 U 11/2010

* cited by examiner

ENGINEERING MACHINE AND STABILITY CONTROL SYSTEM AND CONTROL METHOD THEREOF

CROSS REFERENCE TO RELATED APPLICATIONS

This application is the National Stage of PCT/CN2011/072087 filed on 23 Mar. 2011, which claims priority under 35 U.S.C. §119 of Chinese Application No. 201010139806.0 filed on Mar. 30, 2010, the disclosure of which is incorporated by reference. The international application under PCT article 21(2) was not published in English.

TECHNICAL FIELD

The present invention relates to the field of engineering machine, especially a stability control system for an engineering machine and a control method. The invention also involves an engineering machine comprising the above stability control system.

TECHNICAL BACKGROUND

The stability of engineering machine during working process determines the performance of engineering machine and relates to personal safety of operating personnel at construction site. Therefore, it is essential to ensure the stability of engineering machine during working process.

In order to ensure the stability of engineering machine during construction, the removable overhang leg is generally installed to expand the supporting range of engineering machine and thus avoid the danger of side-tipping. However, if the operating personnel inaccurately or improperly estimate the behaviors of the engineering machine, its likely to cause side-tipping of the engineering machine.

The existing technology provides a stability control system to improve the control on the stability of engineering machine.

Please refer to FIG. 1, which shows the structural diagram of a typical stability control system for an engineering machine in the existing technology.

Stability control system in the existing technology includes pressure sensor 22 and alarm 23. Pressure sensor 22 is installed on the upper chamber of vertical oil cylinder 21 on each leg, and is connected to storage battery through power switch and connected from the other end to alarm 23 which is grounded at the other end.

During working process, operate the leg of the engineering machine and turn off power switch at the same time. When the pressure in the upper chamber of vertical oil cylinder 21 on one leg of the engineering machine is lower than a setting value, the pressure sensor 22 on the leg will send out a voltage signal and transfer the voltage signal to alarm 23. And alarm 23 will send out alarm signals to alert operating personnel to stopping the current operation and changing the operation, thus preventing side-tipping of the engineering machine and improve stability of the engineering machine during working process.

However, the control precision of the above stability control system is relatively low. If the system gives an alarm under relatively high pressure in the upper chamber of vertical oil cylinder on legs, the working scope of the engineering machine will be limited, while the system gives an alarm under relatively low pressure in the upper chamber of vertical oil cylinder 21 on the leg, the potential of side-tipping of the engineering machine will be increased.

Therefore, how to improve stability control precision of the engineering machine becomes the technical problem needed to be solved at present by the technical staff in this field.

CONTENTS OF THE INVENTION

The invention aims to provide a stability control system for an engineering machine and a control method, which have higher control precision. An engineering machine comprising the above stability control system is also provided by the invention.

To solve the above technical problems, the invention provides a stability control system for engineering machine, including detection device, control device and alarm device.

The detection device detects the current center-of-gravity positions of each component of the engineering machine to obtain the center-of-gravity position signals of each component and transmits the center-of-gravity position signals to the control device;

The control device receives the center-of-gravity position signals from the detection device, calculates the center-of-gravity position of the engineering machine according to a center-of-gravity calculation strategy, and compares it with a preset balance range. The control device controls the alarm device for warning when the center-of-gravity position of the engineering machine exceeds the balance range.

It is desirable that, the detection device can also detect the supporting-point position of legs of the engineering machine; the balance range ensures that the supporting point of legs of the engineering machine is in the projection point in horizontal plane, the area formed by the connecting line of two adjacent projection points passes through the safe area upon the first safety calculation, and the center-of-gravity position of the engineering machine is the position of the center-of-gravity projection point of the center-of-gravity of the engineering machine in horizontal plane passing through the safety point upon the second safety calculation; the control device controls the alarm device for warning when the safety point is beyond the safety area.

It is desirable that the safety area is obtained by the said area according to the first safety margin.

It is desirable that the safety point is obtained by the projection point of center-of-gravity according to the second safety margin.

It is desirable that, the safety point is taken as the endpoint to draw a ray perpendicular to the engineering machine along the length direction, and the safety point is considered to be beyond the safety area if the number of cross points of the ray and the connecting line is even number or zero. It is desirable that, the alarm device includes the first alarm device and the second alarm device which are distinctive, and the balance range includes the first balance range and the second balance range which are corresponding to the alarm devices; the first alarm device would give an alarm when the center-of-gravity position is beyond the first balance range, and the second alarm device would give an alarm when the center-of-gravity position is beyond the second balance range.

It is desirable that the center-of-gravity of each component of the engineering machine is obtained by finite element calculation.

It is desirable that the detection device contains turret tilt angle sensor, turret corner sensor, arm support angle sensor, leg angle sensor and leg displacement sensor.

It is desirable that the leg displacement sensor is installed at the end of each leg of the engineering machine.

In order to solve the above technical problems, the invention provides an engineering machine, which comprises the stability control system described in any above item.

A stability control method for the engineering machine is also provided. The engineering machine includes a detection device, a control device and an alarm device, and the method includes the following procedures;

The detection device detects the current center-of-gravity positions of each component of the engineering machine to obtain the center-of-gravity position signals of each component and transmits the center-of-gravity position signals to the control device;

The control device controls the alarm device for warning when the center-of-gravity position of the engineering machine exceeds the balance range.

The stability control system for an engineering machine provided by the invention includes a detection device, a control device and an alarm device. The detection device detects the current center-of-gravity positions of each component of the engineering machine to obtain the center-of-gravity position signals of each component and transmits the center-of-gravity position signals to the control device. The control device receives the center-of-gravity position signals from the detection device, calculates the center-of-gravity position of the engineering machine according to a center-of-gravity calculation strategy, and compares it with a preset balance range. The control device controls the alarm device for warning when the center-of-gravity position of the engineering machine exceeds the balance range. The center-of-gravity of each component is pre-calculated, which is uncertain when the engineering machine is in a certain working condition. Therefore, during working process, the detection device detects the center-of-gravity positions of each component when the engineering machine is in working condition, and transmits the detection signals to the control device. The control device calculates the center-of-gravity position of the entire machine according to a calculation method, and compares it with the balance range of the center-of-gravity position. The control device controls the alarm device for warning when the center-of-gravity position of the engineering machine exceeds the balance range.

In one preferred implementation method, the detection device of the stability control system for an engineering machine provided by the invention also detects the supporting-point position of legs of the engineering machine. The balance range ensures that the supporting point of legs of the engineering machine is in the projection point in horizontal plane, the area formed by the connecting line of two adjacent projection points passes through the safe area upon the first safety calculation, and the center-of-gravity position of the engineering machine is the position of the center-of-gravity projection point of the center-of-gravity of the engineering machine in horizontal plane passing through the safety point upon the second safety calculation; the control device controls the alarm device for warning when the safety point is beyond the safety area. The method for determining the balance range and the center-of-gravity position of the engineering machine can not only ensure control precision, but also ensure the convenience during specific using process, thus reduce the operating difficulties of the stability control system for an engineering machine provided by the invention.

In another preferred implementation method, the specific strategy, for determining whether the center-of-gravity projection point is beyond the area by the stability control system for an engineering machine provided by the invention, is to take the safety point as endpoint to draw a ray perpendicular to the engineering machine along the length direction, and the safety point is considered to be beyond the safety area if the number of cross points of the ray and the connecting line is even number or zero. The above control strategy provides the basis for the setting of control program of the control device, and ensures the realization of the stability control system provided by the present invention.

The beneficial effects of the engineering machine and the stability control method for the engineering machine provided by the invention are similar to the beneficial effects of the stability control system, which are not additionally discussed here.

DESCRIPTION OF ATTACHED FIGURES

SPECIFIC IMPLEMENTATION METHOD

The invention aims to provide a stability control system for an engineering machine and a control method, which have higher stability control precision. An engineering machine comprising the above stability control system is also provided by the invention.

In order to facilitate the technical personnel to better understand the invention, the following part combines attached figures and specific implementation method to make further and detailed description of the invention.

Figure 1:
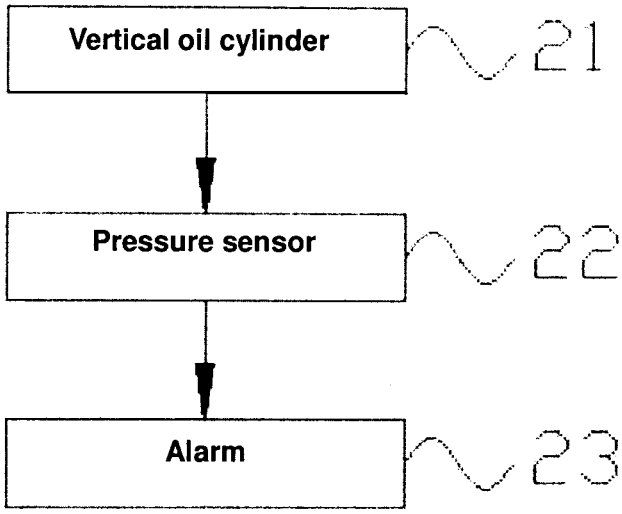
FIG. 1 shows the structural diagram of a typical stability control system for an engineering machine in the existing technology.
Figure 2:
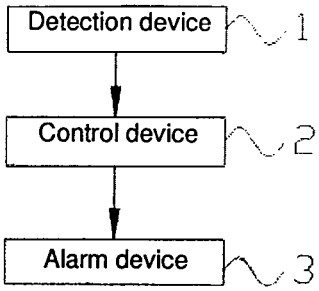
FIG. 2 shows the structural diagram of the stability control system for an engineering machine provided by one specific implementation method of the invention.
Figure 3:
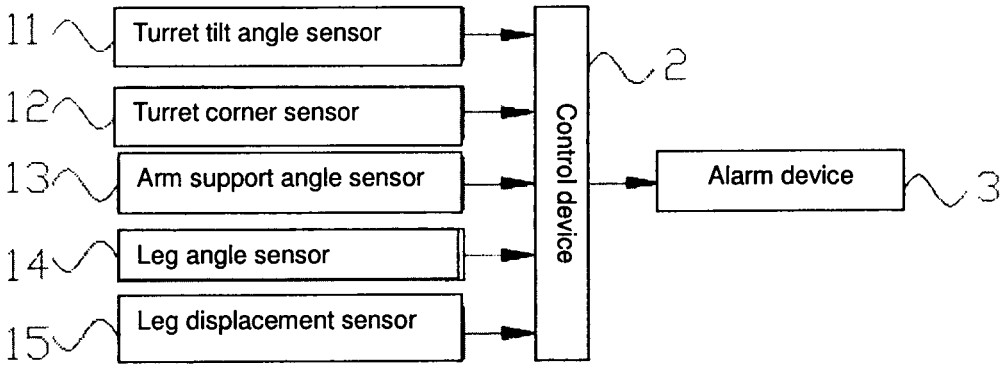
FIG. 3 shows the structural diagram of the stability control system for an engineering machine provided by another specific implementation method of the invention.

Please refer to FIG. 2 and FIG. 3. FIG. 2 shows the structural diagram of the stability control system for an engineering machine provided by one specific implementation method of the invention; FIG. 3 shows the structural diagram of the stability control system for an engineering machine provided by another specific implementation method of the invention.

As shown in FIG. 2, the stability control system for an engineering machine provided by the invention includes a detection device 1, a control device 2 and an alarm device 3. The detection device 1 detects the current center-of-gravity positions of each component of the engineering machine to obtain the center-of-gravity position signals of each component and transmits the center-of-gravity position signals to the control device 2; the control device 2 receives the center-of-gravity position signals from the detection device 1, calculates the center-of-gravity position of the engineering machine according to a center-of-gravity calculation strategy, and compares it with a preset balance range. The control device 2 controls the alarm device 3 for warning when the center-of-gravity position of the engineering machine exceeds the balance range.

The center-of-gravity of each component of the engineering machine is pre-calculated, whose position on each component is constant. While as for the entire engineering machine, with the change of the position of each component on the engineering machine, the center-of-gravity of each component is changing relating to the position of the entire engineering machine. The detection device 1 detects the center-of-gravity position of each component when the engineering machine is under the current working condition. In one specific implementation method, the center-of-gravity position of each component can be obtained by finite element calculation. The center-of-gravity position of each component is constant, relating to the position of the entire engineering machine, therefore, the preset balance range can be obtained via preset calculation method based on the detection point. That is, the preset balance range is changeable to the different positions of each component of the engineering machine.

To be specific, the precision of the above components can be classified according to the needs. Taking concrete pump truck as an example, the components include leg, arm support, turret, vehicle body and cylinder. The above components can be further classified, while the specific classified precision of each component is not limited here.

The detection of the above center-of-gravity position can be realized by the sensor detecting the relative position of each component of engineering machine.

For example, when the stability control system provided by the invention is applied to concrete pump truck, the detection device contains turret tilt angle sensor 11, turret corner sensor 12, arm support angle sensor 13, leg angle sensor 14 and leg displacement sensor 15.

Turret tilt angle sensor 11 detects the included angle of the turret and horizontal plane, turret corner sensor 12 detects the corner under any working position, arm support angle sensor 13 detects the tilt angle of the arm support, leg angle sensor 14 detects the included angle of each leg at supporting positions and the front and back of concrete pump truck, leg displacement sensor 15 detects the extending length of each leg at supporting position. The number of arm support angle sensor 13 and the number of arm support can be same. Each arm support angle sensor 13 respectively detect the included angle of the first arm support of the concrete pump truck and the turret and the included angle of two adjacent arm support. Leg displacement sensor 15 can be installed at the end of each leg of the engineering machine.

Leg displacement sensor 15 is installed at the end of each leg of the engineering machine, which can detect the supporting-point position of each leg, thus to some extent facilitate the determination of the balance range. In addition, leg displacement sensor 15 can be also installed at other places of each leg of the engineering machine, provided that the sensor can be used to detect the center-of-gravity position of each leg.

Based on the detection results from the above sensors, the center-of-gravity position of each component can be obtained when the concrete pump truck is at certain working state.

During working process, the detection device 1 always detects the center-of-gravity position of each component of the engineering machine, and transmits the detection signals to the control device 2. The control device 2 receives the detection signals, calculates the center-of-gravity position of the entire machine according to the preset calculation method, and compares it with the balance range of the center-of-gravity position. The control device 2 controls the alarm device 3 for warning when the center-of-gravity position of the engineering machine exceeds the balance range.

The alarm device 3 can be audible alarm device or visual alarm device or both of the above.

It can be seen that, the stability control system for an engineering machine adopts a brand new method to control the stability of the engineering machine in working process, has higher control precision, and provide basis for the adjustment of working position of each component of the engineering machine.

Figure 4:
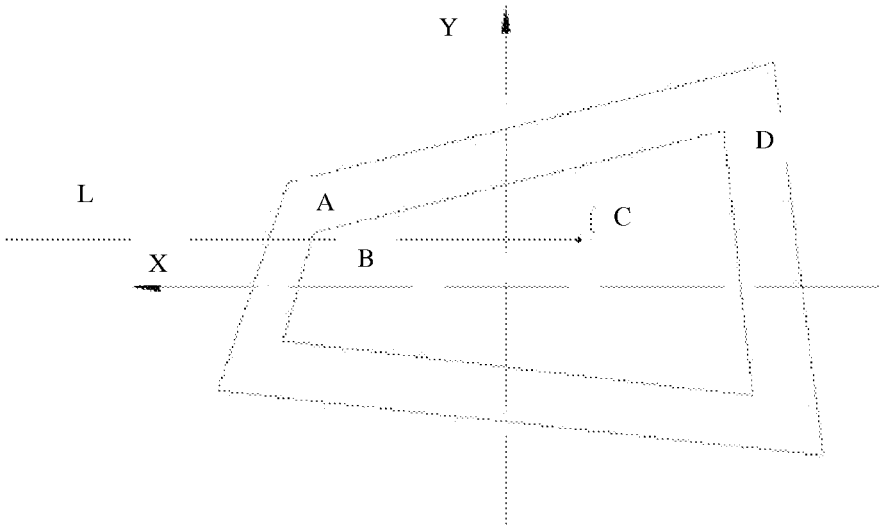
FIG. 4 shows the diagram of the safety area of the stability control system for an engineering machine provided by the invention.

Please refer to FIG. 4, which shows the diagram of the safety area of the stability control system for an engineering machine provided by the invention.

In another specific implementation method, the detection device of the stability control system for an engineering machine provided by the invention also detects the supporting-point position of legs of the engineering machine. The balance range ensures that the supporting point of legs of the engineering machine is in the projection point in horizontal plane, the area A formed by the connecting line of two adjacent projection points passes through the safe area B upon the first safety calculation, and the center-of-gravity position of the engineering machine is the position of the center-of-gravity projection point of the center-of-gravity D of the engineering machine in horizontal plane passing through the safety point C upon the second safety calculation; the control device 2 controls the alarm device 3 for warning when the safety point C is beyond the safety area B.

Either the first safety calculation or the second safety calculation can be 1, which means that no safety calculation is carried out. The reliability depends on the safety calculation of the other. Upon the safety calculation, the possibility for the safety point falling beyond the safety area is increased, and then the control reliability is improved.

The method for determining the balance range and the center-of-gravity position of the engineering machine can not only ensure control precision, but also ensure the convenience during specific using process, thus reduce the operating difficulties of the stability control system for an engineering machine provided by the invention.

The safety area can be the area formed by the connecting line of two adjacent projection points according to the first safety margin. In order to improve the stability, the specific value of the first safety margin shall ensure the range of the safety area is smaller than the range of the area formed by the connecting line of two adjacent projection points. It is obvious that, the safety area can be the area formed by the connecting line of two adjacent projection points according to other calculation methods.

The safety point can be obtained by the center-of-gravity projection point according to the second safety margin. In order to improve the stability, the specific value of the second safety margin shall ensure that the possibility for the center-of-gravity projection point falling in the safety area is increased. It is obvious that the safety point can be obtained by other methods, provided that the improvement of the safety can be guaranteed.

As shown in FIG. 4, the stability control system for the engineering machine provided by the invention adopts the following strategy to determine whether the center-of-gravity projection point falls beyond the area: take safety point C as the endpoint to draw a ray 1 perpendicular to the engineering machine along the length direction, and the safety point C is considered to be beyond the safety area B if the number of cross points of the ray 1 and the connecting line is even number or zero. If the ray and the connecting line coincide with each other, the number of the cross point is considered as 1.

The above control strategy provides the basis for the setting of control program of the control device, and ensures the realization of the stability control system provided by the present invention.

In another specific implementation method, the alarm device of the stability control system for the engineering machine provided by the invention can also include the first alarm device and the second alarm device which are distinctive, and the balance range includes the first balance range and the second balance range which are corresponding to the alarm devices; the first alarm device would give an alarm when the center-of-gravity position is beyond the first balance range, and the second alarm device would give an alarm when the center-of-gravity position is beyond the second balance range. Therefore, the control reliability can be further guaranteed. To be specific, the second balance range can be included in the first balance range. The second alarm device would give an alarm that the operating personnel should be cautious in the following operations when the center-of-gravity position is beyond the second balance range. The first alarm device would give an alarm that the operating personnel should be cautious when the center-of-gravity position is beyond the first balance range.

In order to facilitate the operating personnel to distinguish between alarm signals, the first alarm device and the second alarm device can be of audible alarms in different sounds or light alarms in different colors. Or, one is visual alarm device and the other is audible alarm device.

In addition, in order to solve the above technical problems, an engineering machine comprising the above stability control system is also provided by the invention. The other structures of the engineering machine are identical to the current technology, which are not additionally discussed here.

The stability control method for the engineering machine is also provided. Take concrete pump truck as an example to illustrate the specific procedures of the control method.

Figure 5:
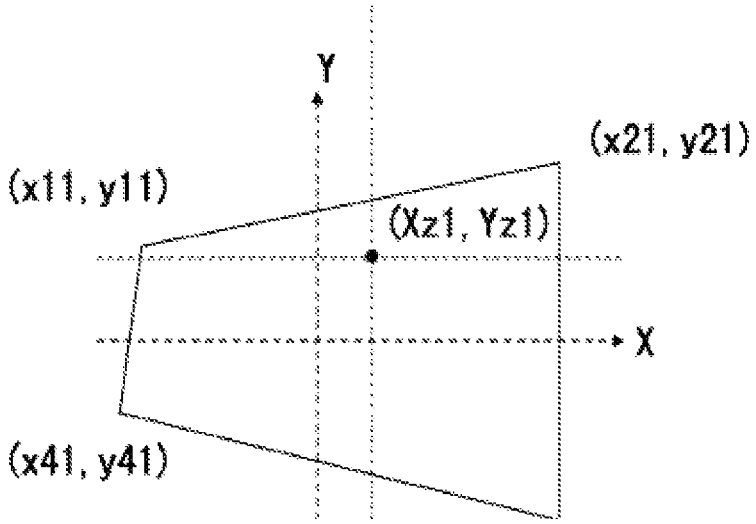
FIG. 5 shows the coordinate diagram of the center-of-gravity projection of the stability control method for an engineering machine provided by the invention.

Calculate the center-of-gravity coordinates of each component of the concrete pump truck;

Install horizontal inclinometer at the turret of the pump truck, displacement sensor at the leg and tilt angle sensor at arm support, to collect the information on horizontal angle of pump truck, position of leg and rotation angle of arm support, and detect the real-time information on geometrical position of pump truck, or transient data of the load, or operational data;

Based on the data from the displacement sensor installed at the leg, the X-axis and Y axis coordinates of the four legs relating to pump turntable can be obtained;

As shown in FIG. 5, project the four supporting points onto the plane of Z=0 and obtain the coordinates of the new supporting points (X11, Y11), (X21, Y21), (X31, Y31), (X41, Y41);

Based on the center-of-gravity position of each component, the installation position of each component at the entire machine and feedback signals from the above sensors by finite element calculation, and according to the formula:

$$x_z = \frac{\sum G_k X_k}{G},$$

$$Y_z = \frac{\sum G_k X_k}{G},$$

$$Z_z = \frac{\sum G_k X_k}{G}$$

Where:

G is the weight of the entire machine, $G_k$ is the weight of a certain component, and $X_k$, $Y_k$, $Z_k$ are the coordinates of a certain component, Calculate the center-of-gravity position of concrete pump truck, multiply $X_z$, $Y_z$, $Z_z$ of the coordinates of the center-of-gravity by the safety margin K, and project onto the plane of Z=0 and get the new coordinates of ($X_z1$, $Y_z1$).

By the following formulas, four boundary lines are obtained:

$$Y=B1;X=B2;Y=B3;X=B4$$

Calculating formulas:

$$(B1-Y11)/(X_z1-X11)=(Y21-Y11)/(X21-X11)$$

$$(Y_z1-Y21)/(B2-X21)=(Y31-Y21)/(X31-X21)$$

$$(B3-Y31)/(X_z1-X31)=(Y41-Y31)/(X41-X31)$$

$$(Y_z1-Y41)/(B4-X41)=(Y11-Y41)/(X11-X41)$$

The sufficient conditions for the center-of-gravity falling in the quadrangle formed by the four supporting points are:

$$(B3<Y_z1<B1) \text{ and } (B4<X_z1<B2)$$

Compare the calculating results with rollover limiting position of pump truck under the current state, and an alarm is given to limit the operation of concrete pump truck if the center-of-gravity is beyond the balance range.

The above contents make a detailed introduction to the engineering machine and the stability control system and control method provided by the present invention. The paper illustrates the principles and implementation methods through examples, facilitating the understanding of the method and core information of the invention. As for the ordinary technical personnel in this field, there are still some room for revision and improvement of the invention, provided that the principles of the invention are complied with. In addition, such revision and improvement are covered in the protection scope of the present invention.

The invention claimed is:

1. A stability control system for an engineering machine comprises a detection device, a control device and an alarm device wherein:

the detection device detects the current center-of-gravity positions of each component of the engineering machine to obtain the center-of-gravity position signals of each component and transmits the center-of-gravity position signals to the control device;

the control device receives the center-of-gravity position signals from the detection device, calculates the center-of-gravity position of the engineering machine according to a center-of-gravity calculation strategy, and compares it with a preset balance range wherein the control device controls the alarm device for warning when the center-of-gravity position of the engineering machine exceeds the balance range;

the balance range ensures that the supporting point of legs of the engineering machine is in the projection point in horizontal plane, the area formed by the connecting line of two adjacent projection points passes through the safe area upon the first safety calculation, and the center-of-gravity position of the engineering machine is the position of the center-of-gravity projection point of the center-of-gravity of the engineering machine in horizontal plane passing through the safety point upon the second safety calculation.

2. The stability control system for an engineering machine as claimed in claim 1, wherein the detection device can also detect the supporting-point position of legs of the engineering machine; and the control device controls the alarm device for warning when the safety point is beyond the safety area.

3. The stability control system for an engineering machine as claimed in claim 2 wherein the safety area is obtained by the area according to the first safety margin.

4. The stability control system for an engineering machine as claimed in claim 2 wherein the safety point is obtained by the projection point of center-of-gravity according to the second safety margin.

5. The stability control system for an engineering machine as claimed in claim 2 wherein the safety point as the endpoint to draw a ray perpendicular to the engineering machine along the length direction, and the safety point is considered to be beyond the safety area if the number of cross points of the ray and the connecting line is even number or zero.

6. The stability control system for an engineering machine as claimed in claim 1 wherein the alarm device includes the first alarm device and the second alarm device which are distinctive, and the balance range includes the first balance range and the second balance range which are corresponding to the alarm devices; the first alarm device would give an alarm when the center-of-gravity position is beyond the first balance range, and the second alarm device would give an alarm when the center-of-gravity position is beyond the second balance range.

7. The stability control system for an engineering machine as claimed in claim 1 wherein the center-of-gravity of each component of the engineering machine is obtained by finite element calculation.

8. The stability control system for an engineering machine as claimed in claim 1 wherein the detection device contains turret tilt angle sensor, turret corner sensor, arm support angle sensor, leg angle sensor and leg displacement sensor.

9. The stability control system for an engineering machine as claimed in claim 8 is: the leg displacement sensor is installed at the end of each leg of the engineering machine.

10. An engineering machine is characterized by containing the stability control system described in claim 1.

11. A stability control method for an engineering machine including a detection device, a control device and an alarm device wherein the method includes the following procedures:

the detection device detects the current center-of-gravity positions of each component of the engineering machine to obtain the center-of-gravity position signals of each component and transmits the center-of-gravity position signals to the control device;

the control device receives the center-of-gravity position signals from the detection device, calculates the center-of-gravity position of the engineering machine according to a center-of-gravity calculation strategy, and compares it with a preset balance range;

the control device controls the alarm device for warning when the center-of-gravity position of the engineering machine exceeds the balance range;

wherein the balance range ensures that the supporting point of legs of the engineering machine is in the projection point in horizontal plane, the area formed by the connecting line of two adjacent projection points passes through the safe area upon the first safety calculation, and the center-of-gravity position of the engineering machine is the position of the center-of-gravity projection point of the center-of-gravity of the engineering machine in horizontal plane passing through the safety point upon the second safety calculation.

12. The characteristic of the stability control method for an engineering machine mentioned in claim 11 wherein the center-of-gravity of each component of the engineering machine is obtained by finite element calculation.

* * * * *